US005934061A

United States Patent [19]

Smith

[11] Patent Number: 5,934,061

[45] Date of Patent: Aug. 10, 1999

[54] APPARATUS FOR ASSEMBLING AND DISASSEMBLING CHAIN

[76] Inventor: Kenneth J. Smith, 27501 265th Street Pl., Princeton, Iowa 52768

[21] Appl. No.: 08/958,451

[22] Filed: Oct. 27, 1997

[51] Int. Cl.[6] ..... B21L 21/00

[52] U.S. Cl. ..... 59/7; 59/35.1

[58] Field of Search ..... 59/7, 8, 35.1

[56] References Cited

U.S. PATENT DOCUMENTS

| | | |
|---|---|---|
| 2,387,551 | 10/1945 | Abramson et al. . |
| 3,135,141 | 6/1964 | Aitken . |
| 3,364,674 | 1/1968 | Banker . |
| 3,553,960 | 1/1971 | Ellefson . |
| 3,816,900 | 6/1974 | Spraker . |
| 4,506,501 | 3/1985 | DeVall et al. . |
| 4,512,070 | 4/1985 | Anhalt . |

FOREIGN PATENT DOCUMENTS

| | | | |
|---|---|---|---|
| 1110013 | 2/1956 | France | 59/7 |
| 436415 | 11/1926 | Germany | 49/7 |
| 626146 | 1/1947 | United Kingdom . | |

*Primary Examiner*—David Jones
*Attorney, Agent, or Firm*—Peter K. Hahn, Esq.

[57] ABSTRACT

An apparatus for assembling and disassembling roller chain and the like is provided. The apparatus includes a base portion made up of a baseplate and side plates, a rotatable cam and an interchangeable die set inserted into the base portion which is in contact with the cam. The die set is sized to fit a particular type and size of chain. The particular die set may be designed to punch out connecting pins in a link of the chain. Alternatively, the die set may be for purposes of installing a link plate onto connecting pins or for purposes of deforming the ends of connecting pins during the assembly process.

20 Claims, 4 Drawing Sheets

APPARATUS FOR ASSEMBLING AND DISASSEMBLING CHAIN

FIELD OF THE INVENTION

This invention relates to an apparatus for assembling and disassembling a section of chain. More particularly, the present invention relates to a cam-based device for pushing out connecting pins of roller chains and the like.

BACKGROUND OF THE INVENTION

Roller chain is in common use today for driving a wide variety of tools and implements. Commonly, roller chain is manufactured in a continuous process. The chain is separated into, for example, hundred foot reels which can then be shipped to distributors. A distributor will then, in turn, ship the roller chain to its dealers or end users in one of two forms—reel form or loop form. Likewise, a dealer may then supply an end user or consumer with the roller chain in loop form for use.

A loop of roller chain is a specific length of chain for a specific type of use, and is formed from the original reel of chain. To form such a loop, at least one of the links of the roller chain must be separated to give the roller chain the proper length. Likewise, the proper length of roller chain must then be reassembled to form the necessary loop.

Numerous devices have been proposed for breaking (i.e., disassembling) roller chain. A typical arrangement employed by these devices features clamp with a screw threaded rod which advances against a roller chain connecting pin to press it out of its link. However, this type of device has proven generally unacceptable in that it frequently damages the roller link ends and ruins substantial amounts of chain. Further, the punch pins of these known devices tend to bend or break, resulting in high Additional devices have been developed which may be hand operated to push pins out of chains. Unfortunately, these devices are cumbersome to operate and require an excessive amount of force to push out the connecting pins. Additionally, these devices typically are sized to fit a particular type of chain or, if sized for a variety of chains, do not have the degree of accuracy necessary for a satisfactory operation. Often however, grinders are used to grind down the heads of connecting pins and then hand punches are used to drive out the pins. This routinely destroys the link plates and often the entire roller link.

Still further, devices have been developed utilizing hydraulic rams to drive pins out of roller chain. As cam be imagined, these devices are extremely bulky and are complicated and costly to manufacture.

Given the foregoing, there is a need for a simple device which can be used to both assemble and disassemble chain of a variety of sizes and types, the ideal device would use interchangeable parts which could easily be inserted and removed from the tool to quickly adjust the tool to match a given size chain.

The present invention is directed to a device for assembling and disassembling, among other things, roller chain. In addition, the present invention is directed to a cam-based device which is simple and easy to manufacture, yet durable. Still further, the invention is directed to a chain assembler and disassembler which allows a single die set to be interchanged to allow the device to accommodate a different size roller chain.

OBJECTS OF THE INVENTION

Accordingly, it is an object of the present invention to provide an improved device for assembling and disassembling chain, and more particularly, roller chain. It is further an object of the present invention to provide a device which is cam-based and utilizes interchangeable die sets. It is still further an object of the present invention to provide an interchangeable die set for the device which, through the exchange of a single part, accommodates a new size chain. It is still further an object of the present invention to provide a device which is simple in construction, yet extremely durable. Yet another object of the present invention is to provide a device which is safe to operate and economical to manufacture.

Other objects, advantages and capabilities of the present invention will become more apparent as the description proceeds.

SUMMARY OF THE INVENTION

In accordance with the present invention, a device for assembling and disassembling chain, and more particularly, roller chain, is provided. The apparatus of the invention, generally stated, includes a base, a cam rotatably attached to said base, and a die set which interacts with the cam.

The die set is designed to facilitate easy insertion and removal from the base assembly. The die set includes an anvil portion and a pusher block portion. The anvil portion of the die set is specifically designed to accommodate a particular type of chain and to effectively engage and restrain the chain during the assembly or disassembly procedure.

The pusher block is designed to be moveable. The pusher block contacts the cam, and upon rotation of the cam, is advanced toward the anvil. Depending on the desired operation, the pusher block may include a variety of components. For example, for purposes of disassembling roller chain, the pusher block typically includes a pair of punches. These punches are sized, spaced and oriented to match the particular type of chain being held in the anvil portion of the tool. Upon rotation of the cam, the pusher block is advanced toward the anvil and the punches of the pusher block concurrently push two connecting pins of a link in the roller chain out of the chain assembly. Once the connecting pins are pushed out of the chain, the cam is reversed, and the pusher block and thus the punches are retracted from the chain.

Alternatively, to utilize the device during the assembly of chain, the pusher block may include a recessed portion to hold a link plate. The link plate is pushed onto the connecting pins of a link being held in the anvil portion. The pressure is applied to the connecting plate by the pusher block as the cam is being rotated.

Still further, once a connecting plate is installed, the connecting pins can be deformed to retain the connecting plate by using a die which includes a staker. The staker, upon rotation of the cam, is pressed into contact with the ends of the connecting pins as the pusher block is advanced. Upon the application of significant pressure, the connecting pin heads are deformed and thereby retain the connecting plate.

In order to facilitate the foregoing operations, the cam of the present invention is an accelerating or multi-stage cam Said differently, the cam of the present invention has a varying cam ratio (i.e., the ratio of displacement to the angle of rotation of the cam). For example, during the disassembly operation, when the cam is in its start position, the point of contact between the cam and the pusher block has a first cam ratio. The first cam ratio is small to produce a large amount of force, with a decreased amount of travel during the initial contact between the punches and the connecting pins. This increased force is required to break the connecting pins free from the link plate. Once the cam has broken the connecting pins free from the link plate, significantly less force is required and an increased amount of travel, relative to the cam rotation, is desired. Accordingly, the cam ratio of the cam after the connecting pins have been broken free has a second and increased cam ratio. By increasing the cam ratio at this point, the travel provided by a given amount of rotation of the cam is significantly increased, thereby facilitating driving the connecting pins completely out of the link.

DETAILED DESCRIPTION OF THE PREFERRED EMBODIMENTS

Figure 1:
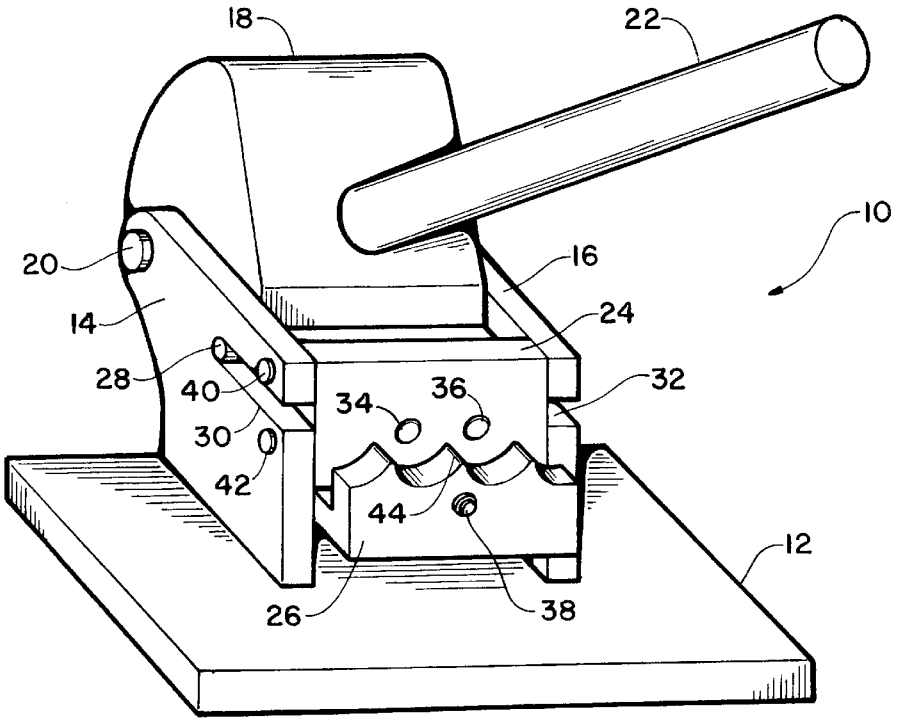
FIG. 1 is an oblique view of the apparatus of the present invention.

Referring initially to FIG. 1, the device of the present invention is shown and generally designated 10. Device 10 includes a base plate 12. Attached to base plate 12 are side plates 14 and 16. Side plates 14 and 16 are preferably connected to base plate 12 by welding or other suitable means. Collectively, base plate 12 and side plates 14 and 16 comprise the base portion of the present invention.

Attached to the base portion is a cam 18. Cam 18 is a rotatable cam mounted on a pivot pin 20. Pivot pin 20 is inserted through openings in side plate 14, cam 18 and side plate 16. Pin 20 is retained in through bores in the side plates by a press fit, welding or by retaining rings or pins on either end of the pin.

A handle or lever 22 is connected to cam 18. Handle or lever 22 can be connected to cam 18 by screw threads, press fit, welding or other suitable means. Although a handle is preferred, other means (hydraulic, electric, etc.) can be used to rotate cam 18 without departing from the present invention.

Also connected to the base is an interchangeable die set 24. Die set 24 includes an anvil portion 26, a pusher block 46 (not shown in FIG. 1) and a guide pin 28 which extends out of either side of pusher block 46 and engages slots 30 and 32 in side plates 14 and 16. Die set 24 also includes punches 34 and 36, for purposes of improving stability of the die set, the die set includes a guide pin 38. Die 24 is retained in the base by means of retaining pins 40 and 42. Retaining pins 40 and 42 are releasably engageable with the side plates and are of a type known to those of ordinary skill in the art. Retaining pins 40 and 42 are commonly referred to as quick release or detent pins. To remove the die set 24 from the base, retaining pins 40 and 42 are pulled free of the device and die 24 is pulled out of the base unit. In this manner, the appropriate die set corresponding to the chain to be manipulated can be installed into the unit.

Figure 2:
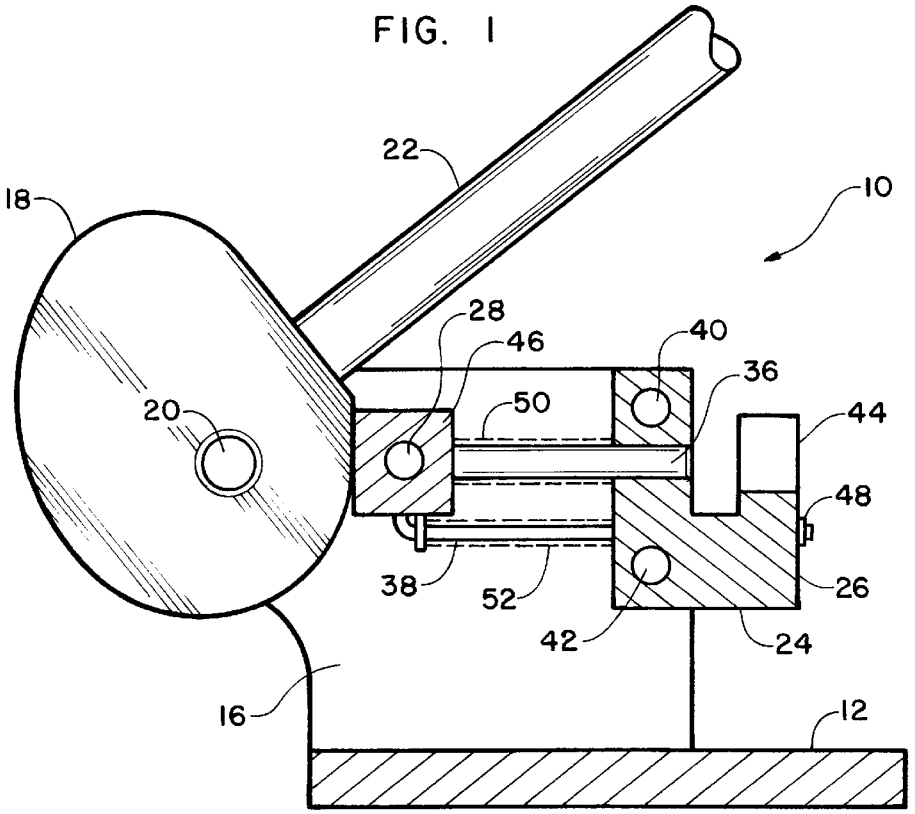
FIG. 2 is a partial cross-sectional view of the apparatus of the present invention configured to disassemble a roller chain.

Referring now to FIG. 2, the apparatus of the present device is again shown and generally designated 10. Device 10 includes base plate 12 and side plate 16 and side plate 14 (not shown). The base portion of the present apparatus is made up of the base plate 12 and the side plates 14 and 16. Attached to side plates 14 and 16 is cam 18 which is rotatably installed on pivot pin 20. A washer or spacer 19 is installed on the pivot pin between the cam and each side plate to keep the cam from sliding on the pivot pin and contacting the side plate. Handle or level 22 is shown attached to cam 18. Only one of the two spacers 19 is visible in FIG. 2.

Connected to the base via side plates 14 and 16 is die set 24. Die set 24 is attached to side plate 16 by means of retaining pins 40 and 42 and guide pin 28 which engages slots 30 and 32 (not shown). Guide pin 28 is normally one of two pins press fit into a bore on either side of pusher 46. Alternatively, guide pin 28 could be a single pin press fit into a through bore in pusher 46. Pin or pins 28 may also be welded to or threaded into pusher 46.

Die set 24 includes an anvil portion 26 which includes teeth 44. Teeth 44 are designed, sized and spaced to correctly engage a chain of a particular type and size. By varying the teeth portion of anvil 26, chains of varying sizes and types can be accommodated.

A pusher block or punch block 46 is connected to and a part of die set 24. Also attached to pusher block 46 is a pair of punches 36 (only one is shown in FIG. 2). Punches 36 are installed into pusher block 46 by preferably a slip fit and retaining screws (to allow easy replacement) or by a pressure fit, by welding or by threading. Importantly, each punch 36 passes through anvil 26 in a through bore. Thus, the components of die set 24 are maintained in proper alignment. Punches 36 are sized, oriented and positioned to precisely align with and correspond to the connecting pins to be pushed out. Preferably punches 36 are the same thickness as the connecting pins or just slightly smaller. Thus, to accommodate a different size or type of chain, the die set can be replaced with a die set that includes the appropriately sized and oriented teeth on the anvil portion and the correctly sized and oriented punches on the pusher portion. In this manner the apparatus is quickly and simply converted from one size of type of chain to another with the exchange of a single part, the die set.

A guide pin 38 is also attached to pusher block 46 by a slip fit, by a pressure fit or by welding. Guide pin 38 extends from pusher block 46 through anvil 26. A retaining pin or clip 48 is preferably installed on the end portion of guide 38 to prevent guide 38 from completely pulling through anvil 26. As those skilled in the art will appreciate, guide pin 38 is for purposes of guiding or maintaining spring 52 in place and in the correct orientation. Additionally, as those skilled in the art will appreciate, if a spring is mounted on the punches, or in recesses in the pusher and the anvil (not shown) guide pin 38 is not required. The springs and their purpose is discussed more below.

In order to keep the pusher block in contact with the cam and to retract the pusher block and thus the punches from the chain when the cam is returned to the original position as shown in FIG. 2, a return spring 50 (shown in phantom) and/or 52 (shown in phantom) may be installed. Spring 50 is installed on punch 36 and spring 52 is shown installed on Guide 38. As those skilled in the art will appreciate, it would be equally feasible to install one or more springs between pusher block 46 and anvil 26 in recesses (not shown) in the pusher block 46 and in the anvil 26 without departing from the spirit and scope of the present invention.

Figure 3:
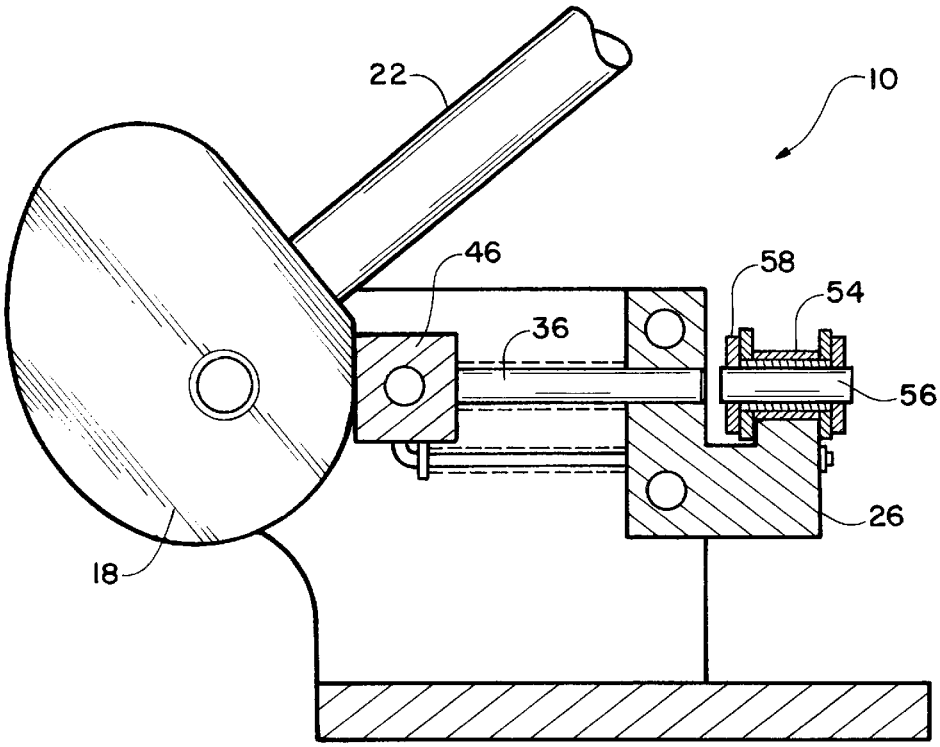
FIG. 3 is a partial cross-sectional view of the apparatus of the present invention configured to disassemble a roller chain and shows the roller chain installed on the apparatus and the apparatus in its start configuration.
Figure 4:
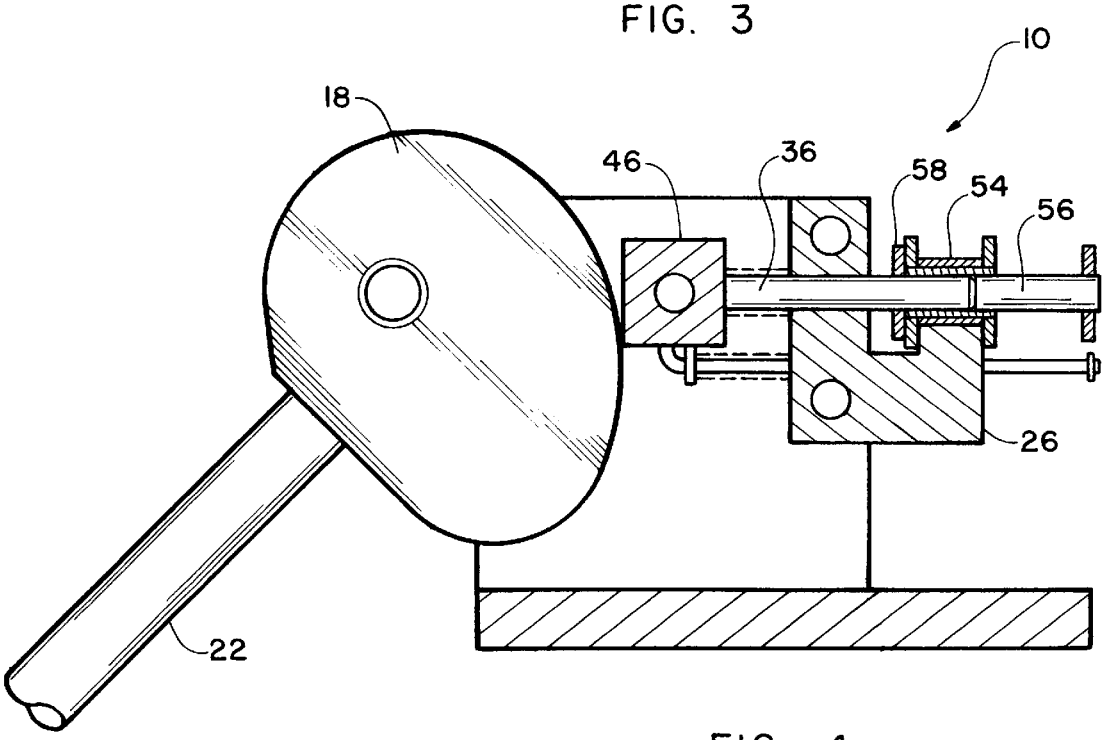
FIG. 4 is a partial cross-sectional view of the apparatus of the present invention configured to disassemble a roller chain and shows the apparatus in an intermediate stage of operation.
Figure 5:
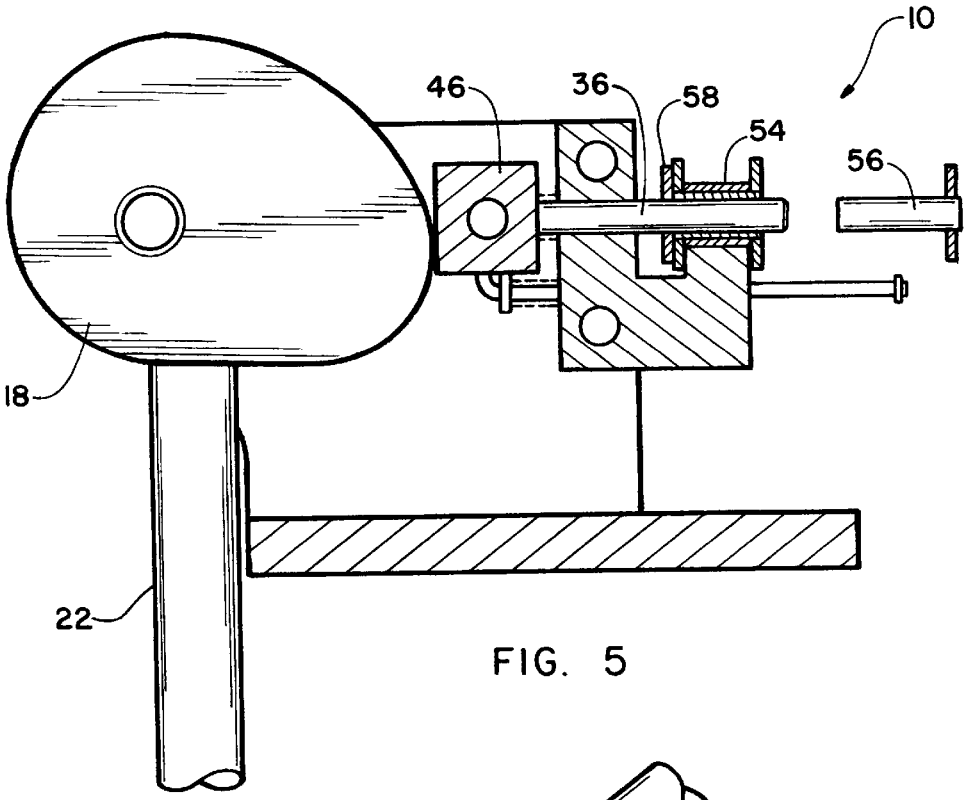
FIG. 5 is a partial cross-sectional view of the apparatus of the present invention, configured to disassemble roller chain and shows the apparatus at the end stage of operation.

The operation of this embodiment of the present invention can be seen through reference to FIGS. 3, 4 and 5, which show, respectively, the initial, intermediate and final orientation of the device during a typical disassembly operation for a chain link.

As can be seen from FIG. 3, device 10 includes handle 22, cam 18, pusher block 46, punch 36, and anvil 26 as previously depicted in FIG. 2. Additionally, a roller chain link 54 is shown installed on anvil 26. Link 54 includes connecting pin 56 and link plate 58. Device 10 is shown in the start position in FIG. 3. In the start position, the pusher block 46 is at the fully retracted configuration. In this orientation, the cam, at the point of contact between the cam 18 and pusher block 46 has a first cam ratio. For purposes of the present disclosure, the cam ratio is the ratio between the lateral displacement caused by the cam (i.e., the amount the pusher is moved by the cam) to the angle of rotation of the cam (i.e., the amount of rotation of the cam). The cam ratio is typically described in units of millimeters displaced per degree of cam rotation (i.e., in./deg.).

Referring now to FIG. 4, device 10 shown in FIG. 3 has now been operated such that handle 22 and thus cam 18 have been rotated counter-clockwise approximately 180 degrees. At this point, the cam ratio has changed to the ending cam ratio. The ending cam ratio is greater than the start cam ratio. Accordingly, at this point as the handle and cam are rotated, the pusher block 46 is moved at a greater rate relative to the rotation of cam 18 than was the case for movement of pusher block 46 at the start cam ratio. The purpose for the two-stage cam (which is also known as an accelerating cam) is that significantly more force is required initially and more movement is desirable later during the rotation of cam 18. By using a smaller start cam ratio initially, significantly more force is being applied than is the case at the ending cam ratio. Likewise, the movement imparted onto pusher block 46 is significantly greater for a given amount of rotation of cam 18 at the ending cam ratio than is the case at the start cam ratio. Preferably, the start cam ratio is about 0.01 and the ending cam ratio is about 0.02. As can be seen from FIG. 4, at this intermediate stage, punch 36 has contacted connecting pin 56 and has broken connecting pin 56 free of link plate 58, although, pin 56 is still partially contained within link 54.

Referring now to FIG. 5, device 10 is in the fully-rotated or ending configuration. In this configuration, pusher block 46 has been moved to its extreme position. Accordingly, punch 36 has now pushed connecting pin 56 completely free of link 54. As those skilled in the art will appreciate, because pusher block 46 preferably includes two parallel punches, each configured such that they will contact both connecting pins of a single link, the operation of device 10 results in both connecting pins being cleared of the link simultaneously. Accordingly, once the device has pushed the connecting pins free of the link, the cam is rotated in the opposite direction back to the start position to retract the punches from the link. Once the cam has again been rotated to the start position, the punches have been cleared of the link and the chain has now been separated.

Figure 6:
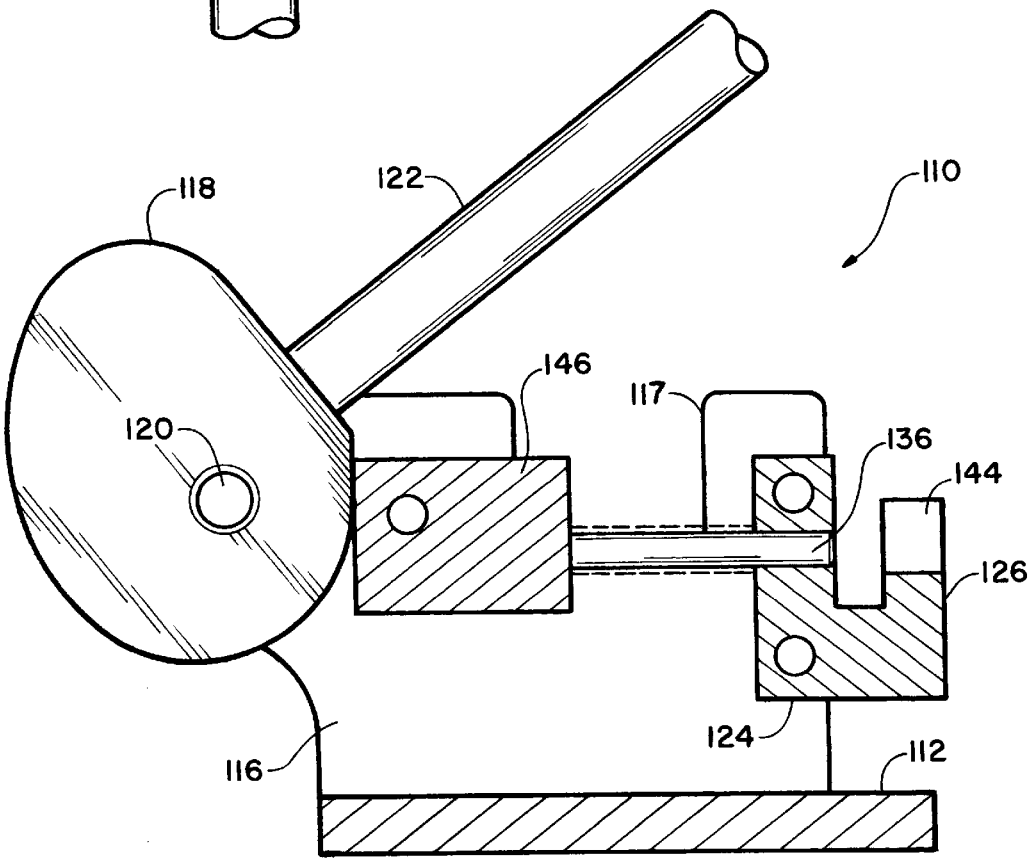
FIG. 6 is a partial cross-sectional view of an alternative embodiment of the present invention configured to disassemble roller chain.
Figure 7:
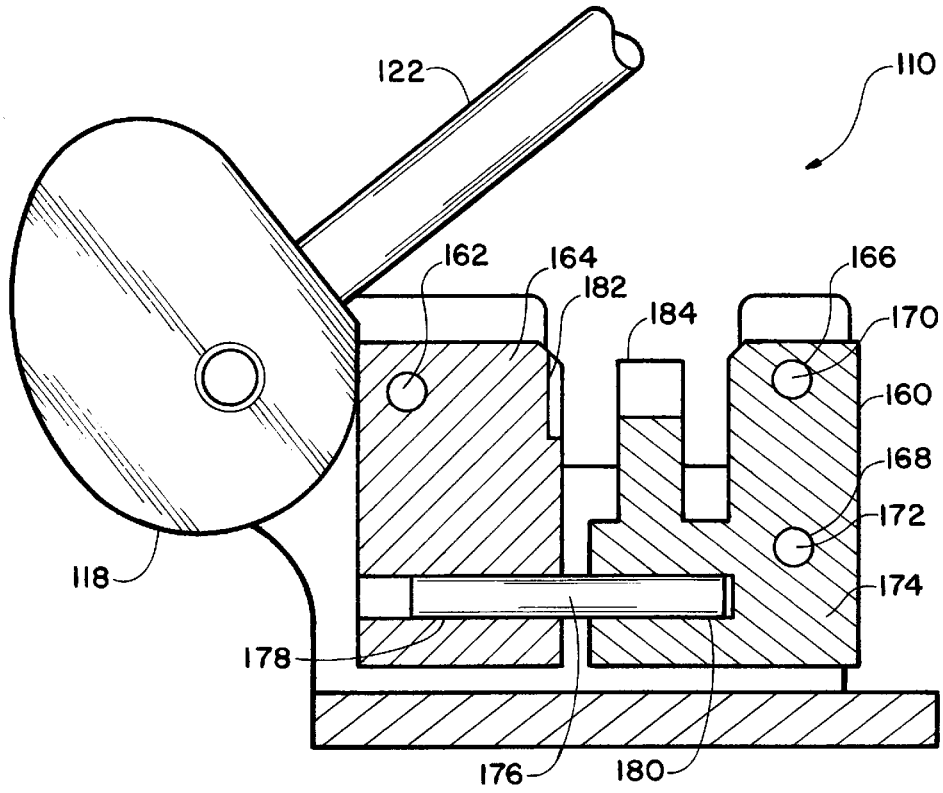
FIG. 7 is a partial cross-sectional view of an alternative embodiment of the present invention configured to receive and press a connecting plate onto the connecting pins of a link of chain.
Figure 8:
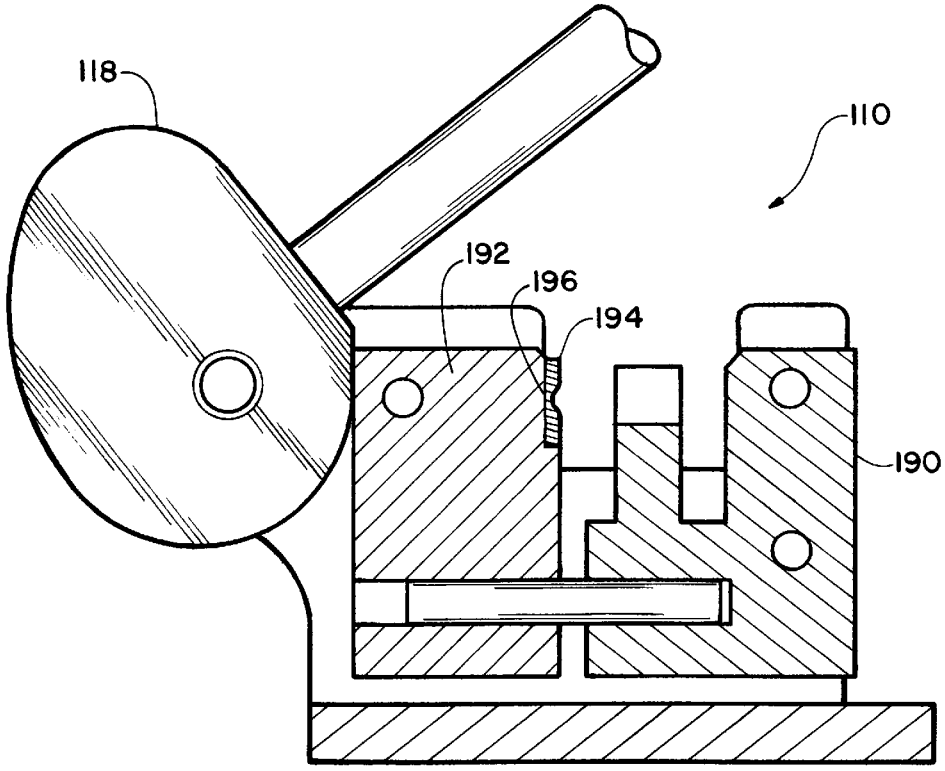
FIG. 8 is a partial cross-sectional view of an alternative embodiment of the present invention configured deform connecting pins of a link of chain.

Referring now to FIGS. 6, 7 and 8, an alternative embodiment of the present invention is shown and generally designated with the numeral 110. Device 110 includes baseplate 112 to which side plate 116 is attached. Additionally, a cam 118 is rotated about a pivot pin 120. Connected to cam 118 is handle or lever 122. Cam 118 is in contact with pusher block 146 which drives punch 136 (and a parallel punch not shown) through anvil 126 of die set 124. Side plate 116 includes a notch 117 which allows a chain to be placed into the device during assembly operations which are described in more detail below.

Device 110 is designed to allow easy removal of die set 124 which is for purposes of disassembling a chain and instead installing plate assembly die set 160 (shown in FIG. 7) or staker assembly die set 190 (shown in FIG. 8). As was the case for the previously described embodiment, the die set rest in slot in the side plates and are retained in the base by the use of retaining pins.

Referring now to FIG. 7, plate assembly die set 160 is shown installed in device 110. Die set 160 may include a guide pin 162 installed in pusher 164 for additional stability. Die set 160 also includes bores 166 and 168 in anvil 174 which receive retaining pins 170 and 172. Anvil 174 and pusher 164 connected one or more, preferably two, guide pins 176 (only one is shown). Guide pin 176 (shown) is contained within a through bore 178 in pusher 164 and a partial bore 180 in anvil 174. Preferably, guide pin 176 is installed in bore 180 with a press fit, but is slidably engaged in bore 178. Alternatively, it would be possible to install guide pin 176 into bore 178 with a press fit, but have a slidable engagement between pin 176 and through bore 180.

Pusher 164 includes a recessed portion 182 which is sized to receive and retain a link plate to be installed onto connection pins of a link. Rotation of handle 122 and cam 118 results in lateral movement of pusher block 164. In this manner, a link plate contained within recess 182 is pushed into and onto the connecting pins of a link held on teeth 184. As those skilled in the art will appreciate, notch 117 in side plate 116 allows the chain to be assembled to fully rest upon teeth 184.

Once the link plate is pushed onto the connecting pins, die set 160 is removed from device 110 and die set 190 is installed into device 110 as is shown in FIG. 8. Die set 190 is similar to die set 160 although in lieu of the recess which held the link plate in die set 160, a staker is included in pusher block 192. Specifically, as can be seen in FIG. 8, a staker 194 is inserted and retained in recess 196. Staker 194 is retained in recess 196 by means of threaded fasteners, but may also be retained by welding or other means known to those skilled in the art. Staker 194 is formed and sized such that both connecting pins of a link can be deformed by a staker in a single operation.

As cam 118 is rotated and pusher 192 is moved laterally, staker 194 is moved into contact with the connecting pins onto which a link plate has been installed. As is known to those skilled in the art, using a staker on the connecting pin, and applying a significant force to the staker and thus the connecting pin, the end of the connecting pin is deformed such that it will retain the link plate.

Thus, the present invention provides an apparatus which can assemble or disassemble chains like roller chain. While the invention has been described with reference to certain preferred embodiments, as those skilled in the art will appreciate, certain changes and modifications can be made without departing from the scope of the present invention as defined by the following claims.

What is claimed is:

1. A device for disassembling a chain, said device comprising:

a base;

a rotatable cam attached to said base; and an interchangeable die set connected to said base, said die set being sized to correspond to a particular size and type of chain, said die set including an anvil and a punch block, said anvil holding said chain during said disassembly, and said punch block being engageable with said cam and movable to contact and move a pair of connecting pins of said chain, said punch block including a pair of punches sized and spaced to engage said pair of connecting pins.

2. The device as claimed in claim 1 wherein said cam is connected to said base by a pivot pin.

3. The device as claimed in claim 1 wherein said base includes a base plate and a pair of side plates, said side plates being substantially perpendicular to said base plate and substantially parallel to each other.

4. The device as claimed in claim 3 further comprising a pivot pin connected to each of said side plates, said pivot pin being at least partially contained in a through bore in said cam such that said cam is between said side plates so that said cam can be rotated relative to said base.

5. The device as claimed in claim 4 further comprising a pair of spacers, each said spacer having a through bore, said pair of spacers being mounted on said pivot pin, one of said pair being on either side of said cam between said cam and the adjacent side plate to prevent contact between said cam and said side plates.

6. The device as claimed in claim 1 wherein said cam has a first cam ratio at a first point of contact between the cam and the punch block when said punch block first contacts said connecting pin of said chain and a second cam ratio at a second point of contact between the cam and the punch block when said punch block has at least partially driven said connecting pin out of said chain.

7. The device as claimed in claim 1 further comprising a lever connected to said cam, said lever being manually operable to rotate said cam thereby moving said punch block.

8. The device as claimed in claim 1 wherein said punches are fixedly attached to said punch block and pass through bores in said anvil to contact said pins of said chain.

9. The device as claimed in claim 1 further including a guide pin engaging said anvil and said punch block to prevent rotational movement of said punch block relative to said anvil.

10. The device as claimed in claim 1 further comprising a return spring between said anvil and said punch block to maintain contact between said cam and said punch block.

11. The device as claimed in claim 1 wherein said die set includes a pair of opposing pins that slidably engage a pair of grooves in said base and said die set is maintained in said base by at least one retaining pin.

12. The device according to claim 6, wherein the second cam ratio is greater than the first cam ratio.

13. A device for assembling a chain, said device comprising:

a base;

a rotatable cam attached to said base; and a plurality of interchangeable die sets, each of said die sets being sized to correspond to a respective size and type of chain and including an anvil and a pusher block, wherein, in use, one of said die sets is connected to said base, said anvil of said one die set holding said chain during said assembly and said punch block of said one die set being engageable with said cam and movable to contact said chain by rotation of said cam.

14. The device as claimed in claim 13 wherein said pusher block includes a recess to hold a connecting link side plate and said pusher block pushes said connecting link side plate onto a pair of connecting pins of said chain when said cam is rotated.

15. The device as claimed in claim 13 wherein said pusher block includes a staker to deform the end of a connecting pin of said chain.

16. A device for assembling and disassembling a chain, said device comprising:

a base;

a rotatable cam attached to said base; and an interchangeable die set connected to said base, said die set being sized to correspond to a particular size and type of chain, said die set including an anvil and a pusher block, said anvil holding said chain and said pusher block being engageable with said cam and movable to contact said chain by rotation of said cam, said cam having a start position and an end position, said cam having an increasing cam ratio at a point of contact between said cam and said pusher block as said cam is rotated from said start position to said end position whereby, for a constant rate of rotation of said cam, said pusher block moves at a slower rate at said start position of said cam and at a greater rate at said end position.

17. The device as claimed in claim 16 wherein said pusher block includes a recess to hold a connecting link side plate and said pusher block pushes said connecting link side plate onto a pair of connecting pins of said chain when said cam is rotated.

18. The device as claimed in claim 16 wherein said pusher block includes a staker to deform the end of a connecting pin of said chain when said cam is rotated.

19. The device as claimed in claim 16 wherein said pusher block includes a pair of punches sized and spaced to engage and push out a corresponding pair of connecting pins of said chain when said cam is rotated.

20. The device as claimed in claim 19 wherein said punches are fixedly attached to said punch block and pass through bores in said anvil to contact said pins of said chain.

* * * * *